US012710252B2

(12) United States Patent
Bishop

(10) Patent No.: US 12,710,252 B2
(45) Date of Patent: Aug. 18, 2026

(54) MARINE BARRIER

(71) Applicant: Bishop Ascendant, Inc., West Caldwell, NJ (US)

(72) Inventor: Justin Bishop, Caldwell, NJ (US)

(73) Assignee: BISHOP ASCENDANT, INC., West Caldwell, NJ (US)

( * ) Notice: Subject to any disclaimer, the term of this patent is extended or adjusted under 35 U.S.C. 154(b) by 366 days.

(21) Appl. No.: 18/187,653

(22) Filed: Mar. 21, 2023

(65) Prior Publication Data

US 2024/0240921 A1 Jul. 18, 2024

Related U.S. Application Data

(60) Provisional application No. 63/480,297, filed on Jan. 18, 2023.

(51) Int. Cl.

| | |
|---|---|
| ***F41H 11/05*** | (2006.01) |
| ***E02B 3/20*** | (2006.01) |
| *E02B 17/00* | (2006.01) |

(52) U.S. Cl.

CPC ..... *F41H 11/05* (2013.01); *E02B 3/20* (2013.01); *E02B 17/0017* (2013.01)

(58) Field of Classification Search

CPC .. F41H 11/05; B63G 9/00; B63G 9/02; B63G 9/04

USPC ..... 405/63; 114/240 R, 241, 240 C, 240 E, 114/240 A

See application file for complete search history.

(56) References Cited

U.S. PATENT DOCUMENTS

2003/0136325 A1* 7/2003 Wooley ..... B63G 9/04 114/240 R
2004/0156266 A1* 8/2004 McDonald ..... G01S 7/529 367/136

FOREIGN PATENT DOCUMENTS

GB 2375739 A * 11/2002 ..... F41H 11/05

* cited by examiner

*Primary Examiner* — Sunil Singh
(74) *Attorney, Agent, or Firm* — NEXUS IP LAW PLLC

(57) ABSTRACT

A marine barrier includes a flexible plate, a plurality of studs mounted on the flexible plate, and a plurality of buoyancy members attached below the flexible plate. The plurality of buoyancy members provides buoyancy for the flexible plate, allowing the plurality of studs above a water surface, while the plurality of buoyancy members below the water surface.

15 Claims, 9 Drawing Sheets

MARINE BARRIER

CROSS REFERENCE TO RELATED APPLICATION

The present application claims priority to U.S. provisional patent application Ser. No. 63/480,297, filed Jan. 18, 2023, which is hereby incorporated herein by reference in its entirety.

FIELD OF THE INVENTION

The present invention relates in general to marine barriers and gates and, more particularly, to marine barriers for capturing the motion of a vessel impacting the barrier.

BACKGROUND OF THE INVENTION

Maritime barriers are used to protect and secure vital maritime structures, such as for example ports, energy facilities, and military assets. Maritime barriers attempt to form a perimeter around an asset both statically like a wall on the water and dynamically as a gate when vessels wish to leave and enter a secure area.

Type 1 barriers were deployed in response to the attacks of September 11th and the attack on the USS Cole. They w ere in many instances ad hoc structures, band aids to a perceived maritime security weakness. Type 11 barriers were more purposefully designed barriers yet still depended on the use of complicated structures and capture mechanisms placed high above the water level to stop a boat. These systems were designed to capture small boats 5-10 meters long traveling at high speed, greater than 40 knots weighing approximately 10,000 pounds with payload. This equates to a kinetic energy at impact with a structure of approximately 600,000 ft-lbf. Type I and II barriers must handle this energy coupled with environmental loading.

Traditional barriers depend on mass and a series of complex interlinked connections to retard the motion of a high-speed small boat. Type I and II barriers are often edifices erected to match the height of a vessel's prow above the water, ensnaring a vessel in a web of fiber ropes and or cables. This can offer quite dramatic and violent testing video of systems that are designed to stop vessels. Systems that promulgate this violent interaction between boat and barrier tends to be expensive per linear foot and prohibitive to use over long waterfront perimeters. Anchoring required to hold these systems in place during environmental loading can be massive. Impact loads must also be carefully plotted through the capturing structure to make it survivable. Any weaknesses that exists can lead key components to wear over time in the dynamic marine environment leading to systems failures and lack of protection for an asset.

For the occupants of a vessel impacting a barrier such as these at high speeds the impact forces can be deadly, if a vessel strays into an area and its occupants innocently approach a barrier at high speed it can result in a fatal tragedy. For military and police forces protecting an area being able to visually see approaching vessels clearly and from the safety of an established perimeter can be quite beneficial in terms of reaction time and use of appropriate force to counter a threat.

Outdated barrier technology that sits at heights 6-8 ft above the water's surface with a portion of a barrier also sitting below the water surface to act as buoyancy supporting a capture mechanism is usually composed of solid panels, ropes, steel cables, nets and hybrid combinations.

These types of barriers typically have large surface area exposed to wind, wave and current that impart significant loads into a structure and force designers to increase the amount of materials, complexity and cost of a system to handle extreme forces. Environmental loads wind, wave and current are combined with impact loads to determine materials specifications connection methods and anchoring types and masses.

With Type I and II engineering becomes more complex and expensive, driving system costs upward. Anchor points become critical not only as hold downs for the barrier against environmental conditions but also load paths for the distribution of the kinetic energy of an impact by a small boat. Anchor points need to be heavier and typically steel not only resisting the forces and snap loads but corrosion and galvanic reactions that can occur in a marine environment.

Therefore, there is a need for improved barriers and barrier systems that remain effective while overcoming the above-described shortcomings.

SUMMARY OF THE INVENTION

The present disclosure provides a security barrier system that addresses the aforementioned problems, and provides an improved security barrier system and components thereof for maritime use.

According to the present disclosure, a marine barrier comprises a flexible plate, a plurality of studs mounted on the flexible plate, and a plurality of buoyancy members attached below the flexible plate. The plurality of buoyancy members provides buoyancy for the flexible plate, allowing the plurality of studs above a water surface, while the plurality of buoyancy members below the water surface.

In some embodiments, the flexible plate is provided with a plurality of holes thereon, and the plurality of studs are seated on the flexible plate through the plurality of holes and anchored into the plurality of buoyancy members beneath the flexible plate.

In some embodiments, the plurality of studs comprises capture studs are cylindrically shaped.

In some embodiments, the plurality of studs comprises anchoring studs which are cylindrically shaped and has a cylindrical core allowing the anchoring elements to pass-through, each of the anchoring studs passes one of the plurality of holes in the flexible plate and held in position.

In some embodiments, the plurality of studs comprises joint studs for joining the flexible plate to another flexible plate, each of the joint studs comprises a threaded body with the ability to pass through overlapped flexible plates.

In some embodiments, a plurality of deadmen are attached to the plurality of buoyancy members by a plurality of chain links.

In some embodiments, the flexible plate is a steel reinforced EPDM (Ethylene-Propylene-Diene Monomer) sheet. In some embodiments, the flexible plate is made of fibers like polyester, dyneema. Kevlar all of which can provide different properties.

In some embodiments, the plurality of buoyancy members are rowed parallelly and traverses the flexible plate to support the flexible plate.

In some embodiments, both ends of each of the transverse-arranged buoyancy members are provided with a cap having a ramp facing outwardly.

In some embodiments, the plurality of studs extend vertically along a length of the flexible plate, and/or horizontally across a width of the flexible plate; the plurality of studs extend through an edge of the flexible edge.

In some embodiments, the plurality of capture studs are provided with a high friction for gripping boat hulls.

In some embodiments, the plurality of buoyancy members under the flexible plate counters the mass of a small boat and lift and small boat out of the water.

In some embodiments, the plurality of buoyancy members provides buoyancy for the flexible plate to maintain a flat profile of the marine barrier with minimal protrusions above the water surface.

In some embodiments, the marine barrier is capable of stopping multiple vessels simultaneously and is equipped with a built-in detection grid capable of pinpointing the location of boats or vessels captured upon the barrier.

Additional advantages and other features of the present disclosure will be set forth in part in the description which follows and in part will become apparent to those having ordinary skill in the art upon examination of the following or may be learned from the practice of the invention. The advantages of the disclosure may be realized and obtained as particularly pointed out in the appended claims. These and other objects, advantages, purposes and features of the present invention will become apparent upon review of the following specification in conjunction with the drawings.

BRIEF DESCRIPTION OF THE DRAWINGS

In order to illustrate the technical solutions of the embodiments of the present invention more clearly, the accompanying drawings used in the embodiments will be briefly introduced below. It should be understood that the following drawings only show some embodiments of the present invention, and therefore do not. It should be regarded as a limitation on the scope, and those skilled in the art can also obtain other related drawings based on these drawings without creative work.

DETAILED DESCRIPTION OF PREFERRED EMBODIMENTS

For the implementation of the present invention, all belong to the protection scope of the present invention. Accordingly, the following detailed description of the embodiments of the invention provided in the accompanying drawings is not intended to limit the scope of the claimed invention, but merely represents selected embodiments of the invention. Based on the implementation manners in the present invention, all other implementation manners obtained by persons of ordinary skill in the art without creative efforts fall within the protection scope of the present invention.

Figure 1:
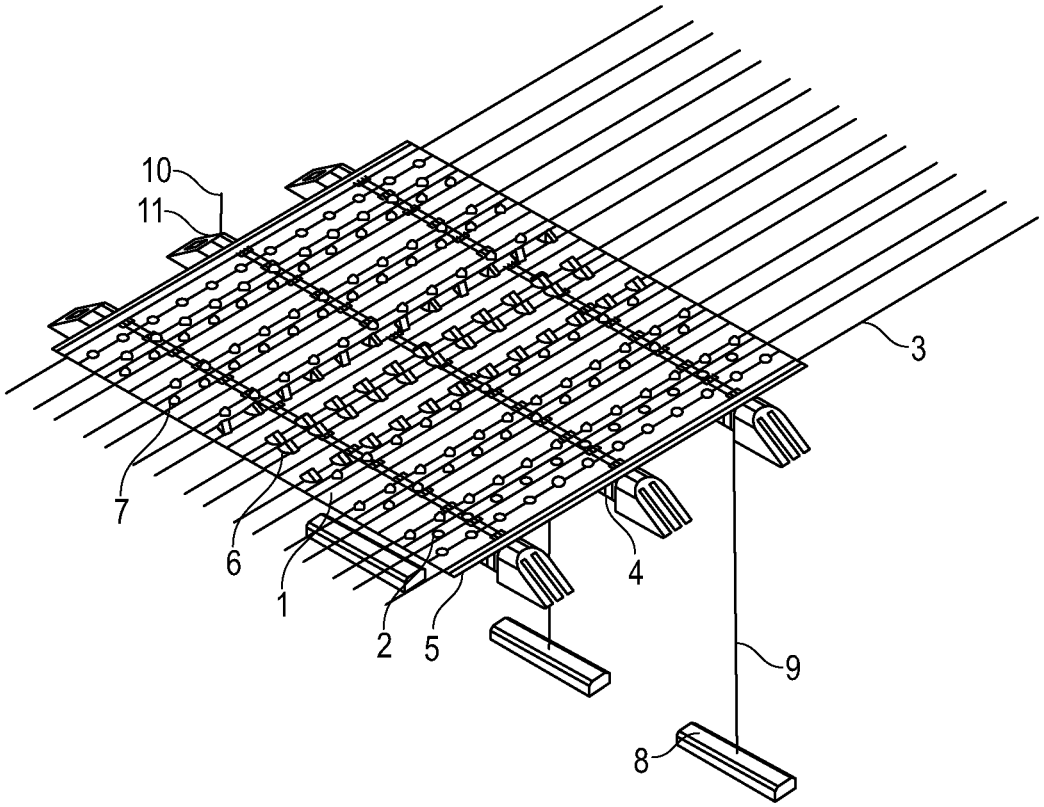
FIG. 1 is a perspective view of a marine barrier according to one embodiment of the present disclosure.
Figure 2:
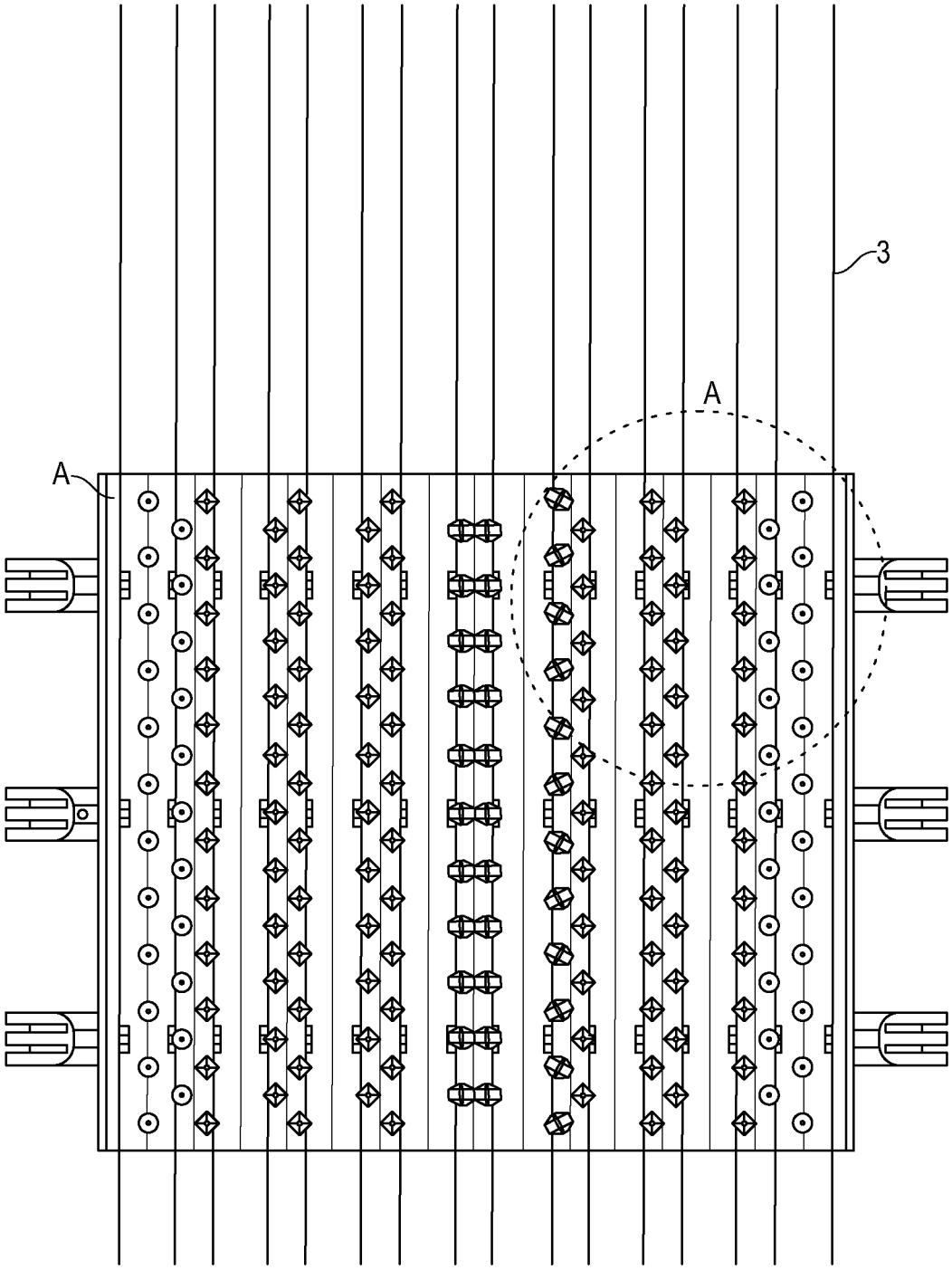
FIG. 2 is a top view of the marine barrier according to one embodiment of the present disclosure.
Figure 3:
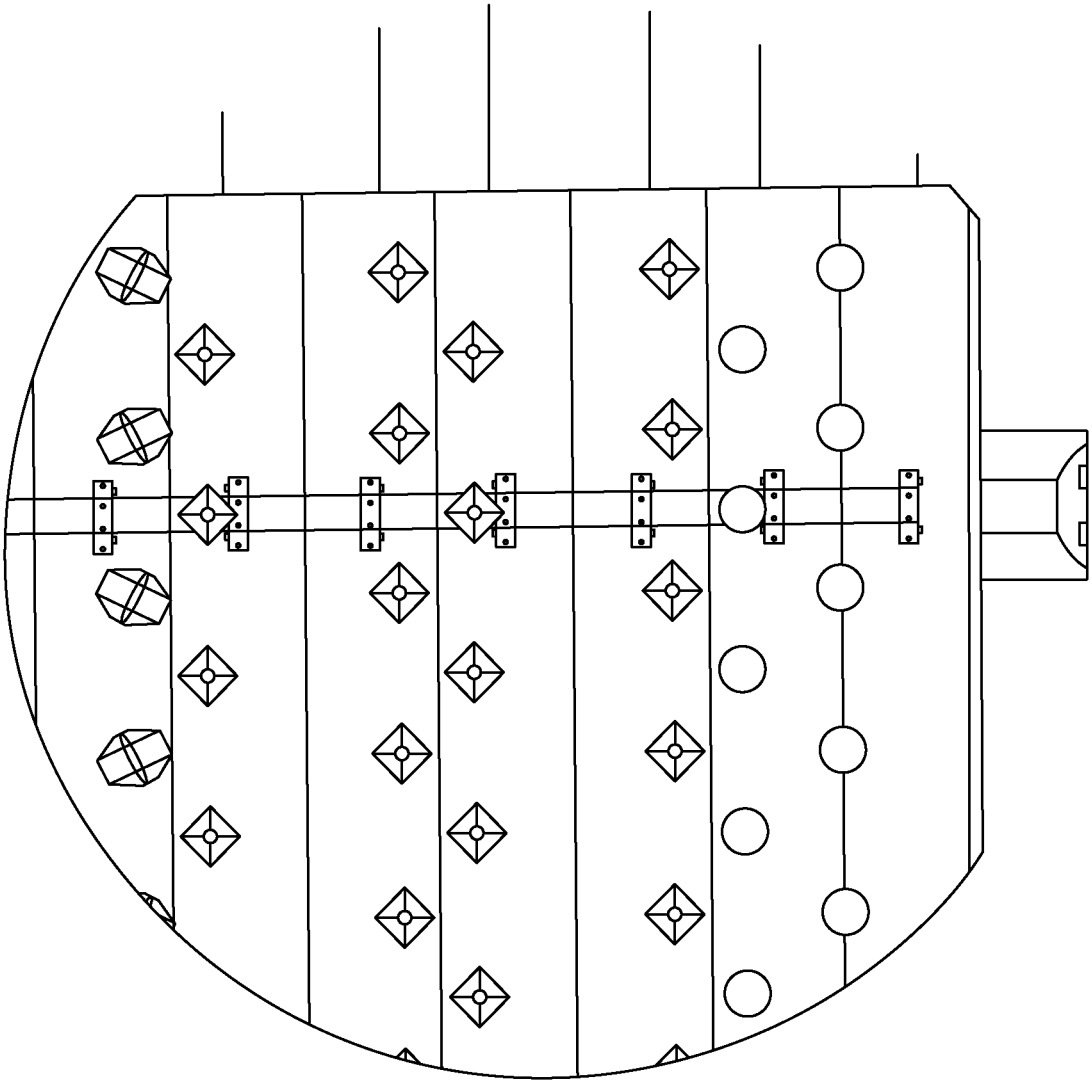
FIG. 3 is an enlarged view of section A in FIG. 2.
Figure 4A:
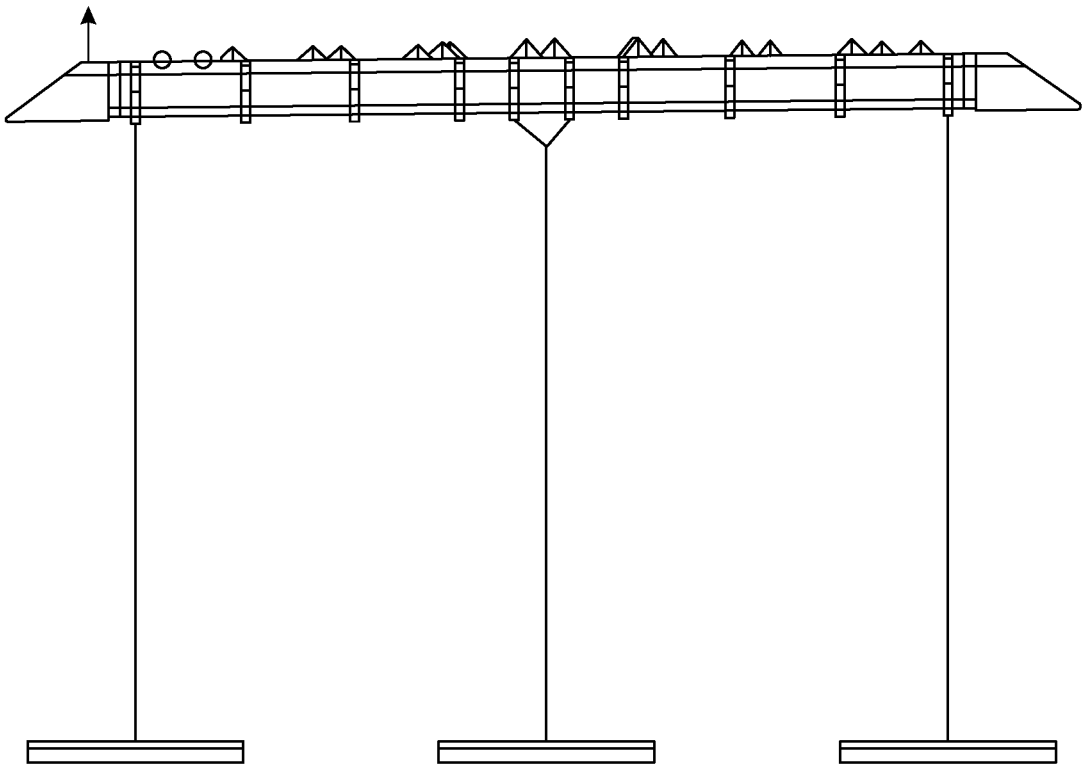
FIG. 4A is a side view of the marine barrier according to one embodiment of the present disclosure.
Figure 4B:
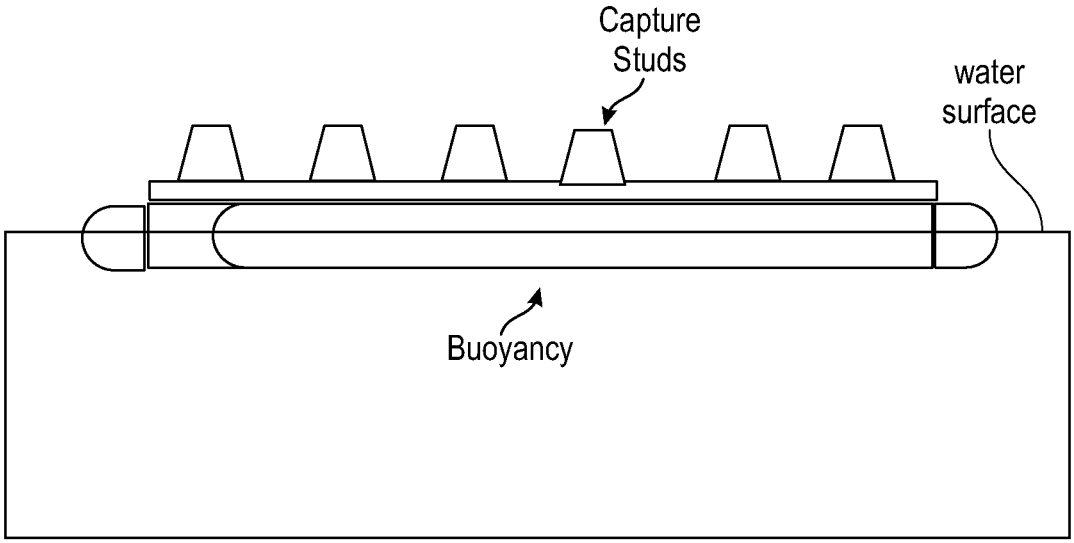
FIG. 4B is a schematic diagram of the marine barrier showing the studs and buoyancy members according to one embodiment of the present disclosure.
Figure 5:
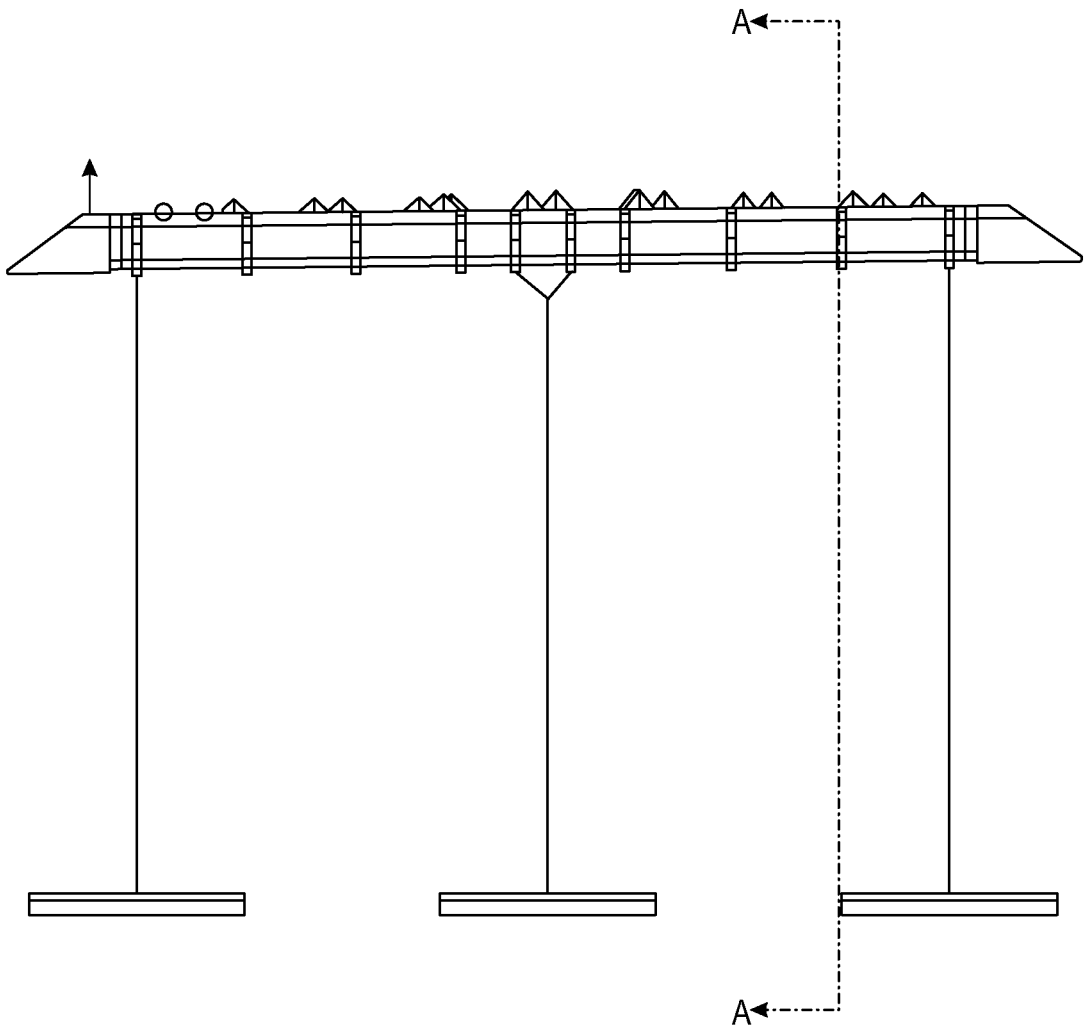
FIG. 5 is a sectional view of A-A in FIG. 4A.
Figure 6:
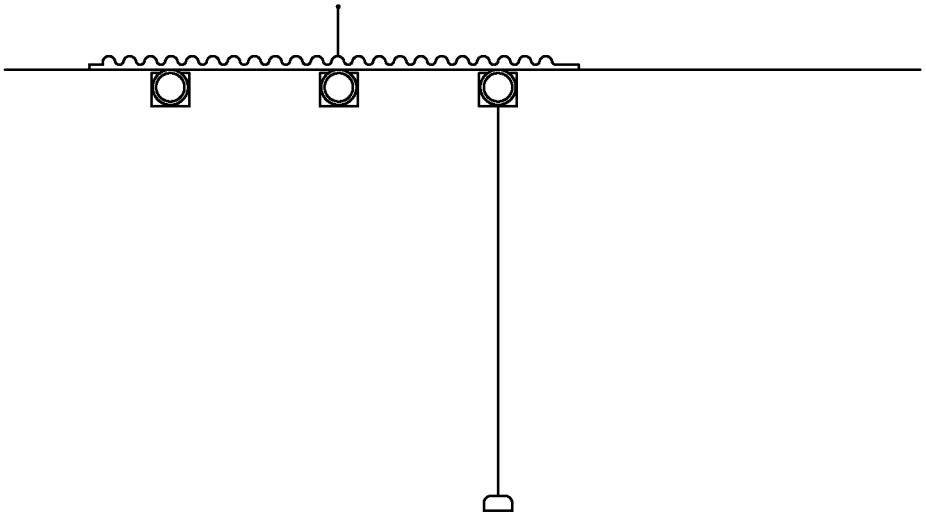
FIG. 6 is an enlarged view of one of the buoyancy members in FIG. 5.

Referring to FIGS. 1-11, a marine barrier according to one embodiment of the present disclosure is illustrated. As shown in FIG. 1, the marine barrier includes a flexible plate 1, a plurality of studs 2, 6, and 7 mounted on the flexible plate, and a plurality of buoyancy members 4 attached below the flexible plate 1. The plurality of buoyancy members 4 provides buoyancy for the flexible plate 1, allowing the plurality of studs 2, 6, and 7 above a water surface, while the plurality of buoyancy members 4 below the water surface. For purposed of understanding, the water surface is shown in FIG. 4B. A plurality of deadmen 8 are attached to the plurality of buoyancy members 4 by a plurality of chain links 9. In the present embodiments, the plurality of deadmen 8 may be concrete.

Figure 7:
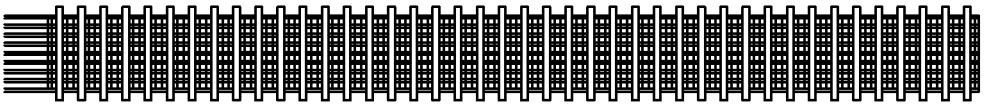
FIG. 7 is a top view of the marine barrier according to another embodiment of the present disclosure.
Figure 8:
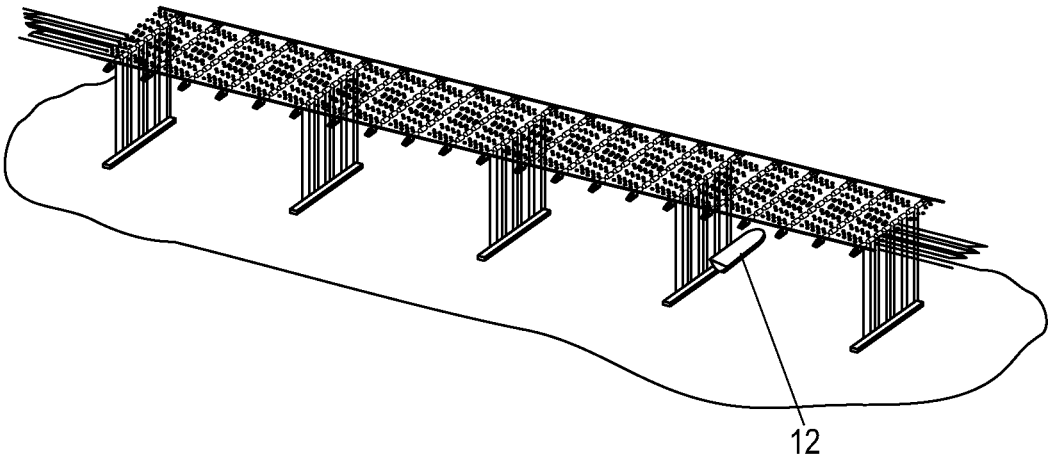
FIG. 8 is a schematic diagram showing the marine barrier and a boat (vessel) heading to the marine barrier according to the disclosure.
Figure 9:
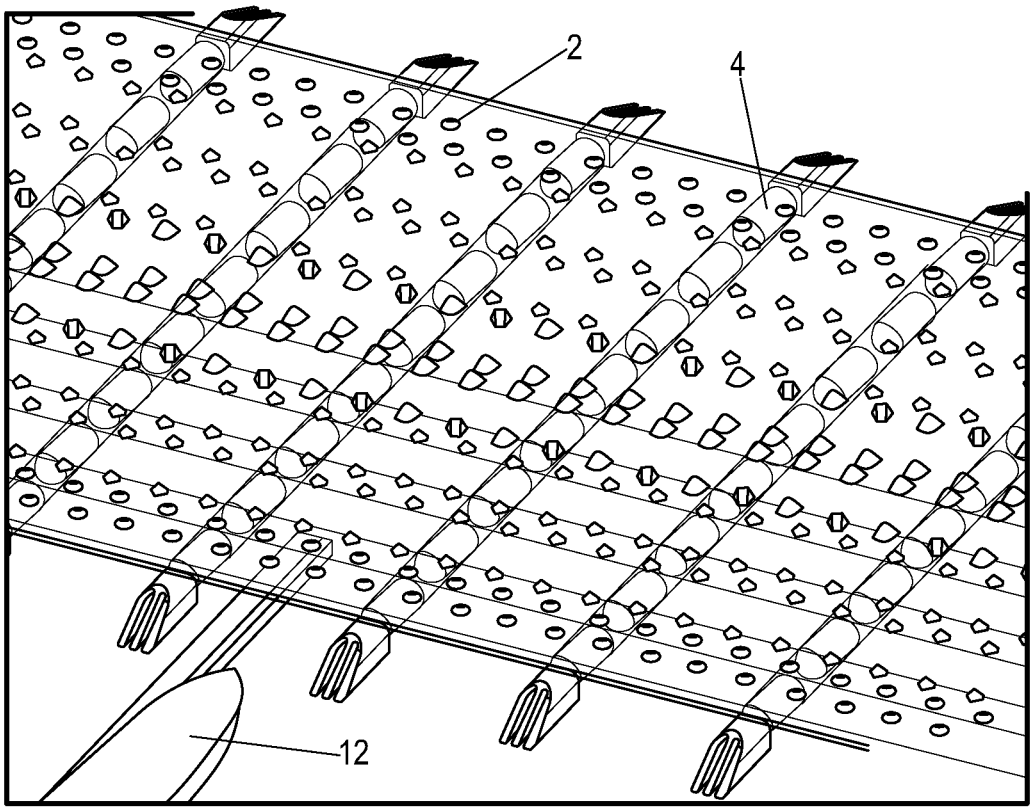
FIG. 9 is a schematic diagram showing more detail of the marine barrier and a boat (vessel) heading to the marine barrier according to the disclosure.
Figure 10:
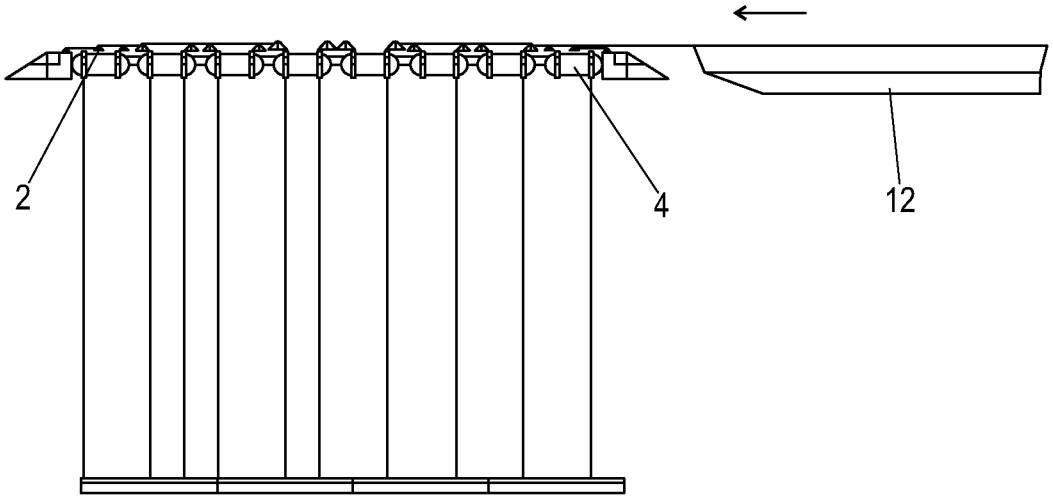
FIG. 10 is a schematic diagram in another view showing the marine barrier and a boat (vessel) heading to the marine barrier according to the disclosure.
Figure 11:
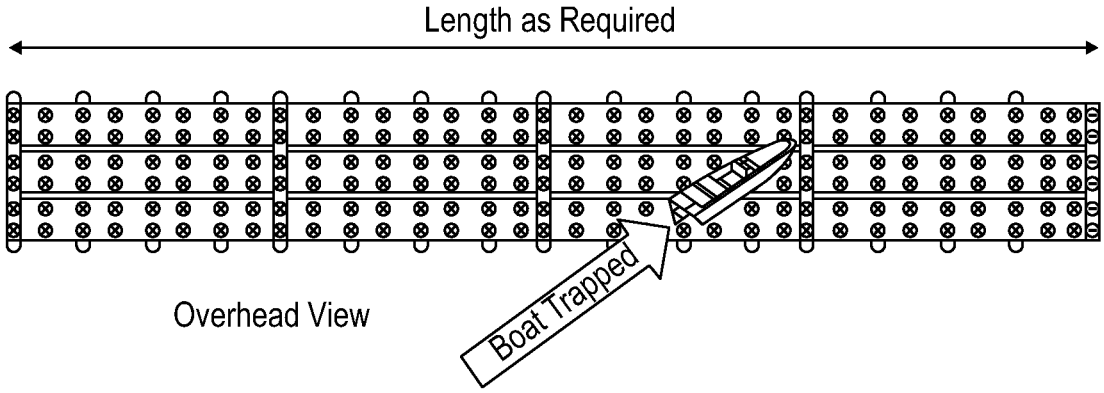
FIG. 11 is a schematic diagram of the boat trapped by the marine barrier according to the disclosure.

The flexible plate 1 in this embodiment is a thick flexible composite plate, and form the building blocks of the marine barrier. In FIG. 1, only one flexible plate is illustrated. However, more flexible plates may be used to interconnected with the illustrated flexible plate forming long lengths of barrier, as shown in FIG. 7. The flexible plate may be rectangular, and provides a mounting surface for high friction studs above the water level, and the plurality of buoyancy members 4 below the water surface. Apertures across the surface allow for various mounting patterns for the plurality of studs tailoring performance to vessel threat.

Multiple patterns may be laid out upon the surface of the floating friction plate. Various heights of the plurality of studs also allow, for variability in design and optimization of vessel capture.

The flexible plate 1 is provided with a plurality of holes thereon, and the plurality of studs 2, 6, and 7 are seated on the flexible plate 1 through the plurality of holes and anchored into the plurality of buoyancy members 4 beneath the flexible plate 1.

The plurality of studs 2, 6, and 7 comprise capture studs that are cylindrically shaped. The cylindrically shaped capture studs are seated in the flexible plate 1 through holes in the flexible plate and anchored into the plurality of buoyancy members 4 beneath the flexible plate 1. The capture studs are made with a high friction urethane designed specifically to grip boat hulls. Height, diameter, pattern and composition of studs can all be optimized to meet type of threat encountered. In this embodiment, the studs 2, 6 and 7 are made of rubber. More particularly, the studs 2 are small studs, the studs 6 are large studs, and the studs 7 are medium.

The plurality of studs comprises anchoring studs which are cylindrically shaped and has a cylindrical core allowing the anchoring elements to passthrough. Each of the anchoring studs passes one of the plurality of holes in the flexible plate and held in position. The anchoring studs are similar in shape to the capture studs, but allow the passthrough of anchoring elements through a cylindrical core at the center of the anchoring stud. The central core may contain anchoring elements eyes and studs or act as a pass through for mooring elements, ropes chains etc. The anchoring studs pass through multiple flexible plates 1 through holes in the flexible plates 1 and are held in position by means of a threaded body, composite capture nut, or pin system. In some embodiments, the anchoring studs may also be glued or welded in position.

The plurality of studs comprises joint studs for joining the flexible plate to another flexible plate 1. Each of the joint studs comprises a threaded body with the ability to pass through overlapped flexible plates. The joint studs are applied at areas between flexible plates 1. An overlap of plate material allows lengths of barrier to be joined together using cylindrical joint studs which are similar in design to the capture studs. The joint studs are used to join flexible plates together laterally and longitudinally where necessary. The joint studs have the same look as capture studs but may be different heights and have a threaded body with the ability to pass through multiple overlapped friction plates. The end of the joint stud may be captured with a composite nut and pinned locking arrangement. The length of the joint studs will be greater to account for the overlap of materials and threading required to achieve desired holding power.

The plurality of buoyancy members 4 are polyethylene foam billets, and are encapsulated in urethane and provide the buoyancy necessary to maintain the height of the capture studs above the water surface for the marine barrier to operate effectively. The profile of the billet is designed to provide the maximum amount of buoyancy while keeping a reduced drag profile.

The billets have apertures to allow the insertion and retention of the capture studs, the joint studs, and the anchoring studs or the pass through of anchoring elements.

The marine barrier is built using marine grade components. Using urethane rubbers in the capture mechanism. In the present disclosure, friction and buoyancy are used to stop vessel's forward motion. In some embodiments, the flexible plate may be a steel reinforced EPDM (Ethylene-Propylene-Diene Monomer) sheet. In some embodiments, the flexible plate is made of fibers like pol ester, dyneema. Kevlar all of which can provide different properties. The EPDM rubber materials and polyethylene buoyancy members support the flexible plates.

In some embodiments, the plurality of buoyancy members are rowed parallelly and traverses the flexible plate to support the flexible plate, both ends of each of the traverse-arranged buoyancy members are provided with a cap having a ramp facing outwardly. The plurality of studs extend vertically along a length of the flexible plate, and/or horizontally across a width of the flexible plate; the plurality of studs extend through an edge of the flexible edge.

The marine barrier is designed to accommodate a wide variety of anchoring systems, mass driven, embedment piling even pier and shore mounting is possible. The flexible nature of the marine barrier allows unique placement and attachment options. The anchoring studs composed of composite materials can mount lifting eyes, anchoring eyes, rope and chain pass throughs.

In some embodiments, the marine barrier may either be deployed in a static or dynamic configuration as either a perimeter or an automated point of entry. The marine barrier offers a fully automated gate secured to the shoreline via its opening and closing apparatus and roller mechanism. The barrier is capable of being stored completely on land and then unfurled as required. Opening channel width of a protected asset is never compromised leaving vessels a clear approach and channel to navigate within when the gate is retracted. Once vessels have passed into and out of port the barrier can be deployed within minutes closing the channel. The low drag of the gate in the water allows for a rapid opening and closing sequence in all weather conditions.

In some embodiments, the marine barrier is capable of mounting a sensor grid to detect tampering, trespass and impact. It can also mount underwater detection gear for sensing the presence of divers underwater vehicle etc. The marine barrier has ample room and buoyancy to mount underwater barriers were deemed effective in either a static or dynamic application. Anchoring studs can be used to run a jack line across the breadth of the structure which can support netting and underwater entanglement systems.

The marine barrier in the present disclosure has the lowest observable profile facing into the wind, waves and current, the thin edge of the friction plate faces these forces and sees reductions of load nearly half that of Type I and II systems in the prior art. Uplift is also minimized with apertures built into the faces of the flexible plates allowing vertical upwelling across the surface of the flexible plate. All exposed surfaces are rounded and smooth allowing optimal flow in and around the marine barrier by currents. Wind has no surface to grab as the profile of the marine barrier is flat with minimal protrusions above the surface. The marine barrier is a wave rider and does not try to fight w a energy but coexist with it again reducing loads across the structure. Vessels do not impact the structure therefore no impact loads are imparted, vessels are grounded on top of the marine barrier, the surface is composed of materials that offer the highest coefficient of friction possible which is ultimately what slows and grabs the vessels hull. Buoyancy of the flexible plates elevates the propulsion system of the small boat out of the water. The use of friction and buoyancy eliminates the need for the barrier to transmit significant impact energies through load paths within the marine barrier. This saves engineering time and money in the design and deployment of the structure and its anchoring means.

Changes and modifications in the specifically described embodiments may be carried out without departing from the principles of the present intention, which is intended to be limited only by the scope of the appended claims, as interpreted according to the principles of patent law including the doctrine of equivalents.

The embodiments of the invention in which an exclusive property or privilege is claimed are defined as follows:

1. A marine barrier comprising:

a flexible plate;

a plurality of studs mounted on the flexible plate, the plurality of studs including one or more capture studs having high-friction polymer surface and one or more joint studs having a threaded body configured for joining the flexible plate with another flexible plate; and a plurality of buoyancy members attached below the flexible plate;

wherein the plurality of buoyancy members provides buoyancy for the flexible plate allowing the plurality of studs above a water surface, while the plurality of buoyancy members below the water surface.

2. The marine barrier according to claim 1, wherein the flexible plate is provided with a plurality of holes thereon, and the plurality of studs are seated on the flexible plate through the plurality of holes and anchored into the plurality of buoyancy members beneath the flexible plate.

3. The marine barrier according to claim 2, wherein the plurality of studs includes one or more anchoring studs, each of the one or more anchoring studs being cylindrically shaped and having a cylindrical core allowing an anchoring element to passthrough, each of the one or more anchoring studs is configured to pass one of the plurality of holes in the flexible plate and held in position.

4. The marine barrier according to claim 1, wherein the one or more capture studs are cylindrically shaped.

5. The marine barrier according to claim 1, wherein the threaded body of the one or more joint studs is configured to pass through overlapped flexible plates when the flexible plate is joined with the other flexible plate.

6. The marine barrier according to claim 1, wherein the plurality of buoyancy members is interconnected to form a parallel row.

7. The marine barrier according to claim 1, wherein a plurality of deadmen is attached to the plurality of buoyancy members by a plurality of chain links.

8. The marine barrier according to claim 1, wherein the flexible plate is a steel reinforced EPDM (Ethylene-Propylene-Diene Monomer) sheet.

9. The marine barrier according to claim 1, wherein the plurality of buoyancy members is rowed parallelly and traverses the flexible plate to support the flexible plate.

10. The marine barrier according to claim 9, wherein both ends of each of the traverse-arranged buoyancy members are provided with a cap having a ramp facing outwardly.

11. The marine barrier according to claim 1, wherein the plurality of studs extends vertically along a length of the flexible plate or horizontally across a width of the flexible plate, and wherein the plurality of studs extends through an edge of a flexible edge.

12. The marine barrier according to claim 1, wherein the one or more capture studs are provided with a high-friction rubber for gripping boat hulls.

13. The marine barrier according to claim 1, wherein the plurality of buoyancy members is configured to counter and support a vessel above the water surface.

14. The marine barrier according to claim 1, wherein the plurality of buoyancy members provides buoyancy for the flexible plate to maintain a flat profile of the marine barrier with minimal protrusions above the water surface.

15. The marine barrier according to claim 1, wherein the marine barrier is capable of stopping one or more vessels simultaneously and is equipped with a built-in detection grid capable of pinpointing a location of the one or more vessels captured upon the marine barrier.

* * * * *